United States Patent [19]

Haeberle, Jr.

[11] 4,066,448

[45] Jan. 3, 1978

[54] NICKEL-CHROMIUM-COBALT CONTAINING ALLOYS

[75] Inventor: Ronald Mason Haeberle, Jr., Huntington, W. Va.

[73] Assignee: The International Nickel Company, Inc., New York, N.Y.

[21] Appl. No.: 674,568

[22] Filed: Apr. 7, 1976

[51] Int. Cl.[2] ..... C22C 19/05

[52] U.S. Cl. ..... 75/171; 75/134 F; 148/32

[58] Field of Search ..... 75/171, 170, 134 F; 148/32, 32.5

[56] References Cited

U.S. PATENT DOCUMENTS

| | | | |
|---|---|---|---|
| 2,809,139 | 10/1957 | Bloom et al. | 75/171 |
| 3,519,419 | 7/1970 | Gibson et al. | 75/171 |

*Primary Examiner*—R. Dean

*Attorney, Agent, or Firm*—Raymond J. Kenny; Ewan C. MacQueen

[57] ABSTRACT

High-chromium nickel alloys containing special amounts of cobalt and other ingredients are found to afford a good combination of both hot and cold workability, together with corrosion resistance, stability and high temperature stress rupture characteristics.

8 Claims, 3 Drawing Figures

Figure 1:
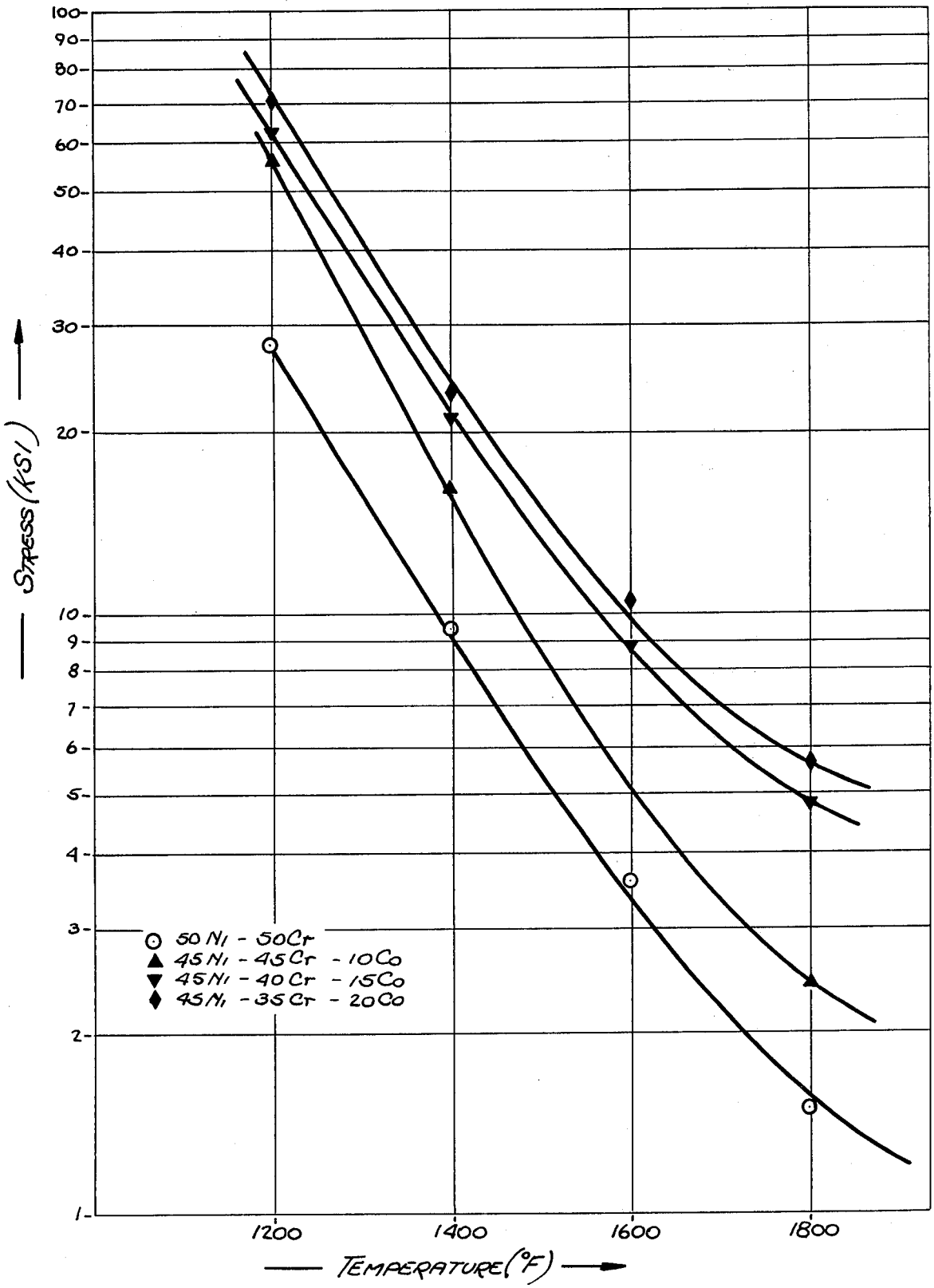

STRESS FOR 100 HOUR LIFE
ANNEALED 2200°F/1+AC

HOT CORROSION RESISTANCE
80% $V_2O_5$ + 20% $Na_2SO_4$
16 Hr./1650°F

NICKEL-CHROMIUM-COBALT CONTAINING ALLOYS

The subject invention is concerned with corrosion-resistant high-chromium nickel alloys, i.e., those of the 50% Cr-50% Ni type, and is particularly directed to a novel composition characterized by an exceptional combination of workability, including cold as well as hot workability, high temperature stress-rupture strength, hot corrosion resistance, elevated temperature stability, etc.

Alloys approximately of 45–50% chromium and 55–50% nickel as well known for their ability to afford excellent resistance to a host of corrosive media while delivering at least a useable, though hardly exceptional, level of stress-rupture strength. For example, these alloys seem to be among the few endowed with an inherent capability to appreciably resist the ravages occasioned by the degrading effects of fuel ash at elevated temperatures, a most aggressive corrosive environment. However, such virtues notwithstanding, alloys of the type under consideration are given to manifest poor workability.

A number of proposals have been advanced to improve workability, at least hot workability. Indeed, a measure of success has been achieved. Nonetheless, and insofar as I am aware, such alloys are still largely produced in cast form by reason of the difficulties attendant the hot working process. A cladding method is also used, the weaker Ni-Cr being cladded to a stronger substrate. Such techniques are inherently self-limiting, either by reason of cost, or, in the case of the casting process limited product shapes and segregation problems. This is not to say these alloys are not commercially produced in the hot worked condition. Rather, the commercial drawback is that the severity of the hot workability problem has ostensibly resulted in restricting the scope of application of such materials.

If contending with the hot working problem has proven to be difficult, perhaps more so has been the problem associated with cold workability (measured by cold ductility herein, as is customary). Indeed, insofar as I am presently aware, there is no commercially produced wrought 50% Cr-50% Ni alloy which manifests a large degree of cold ductility as contemplated in accordance herewith. This again has undoubtedly limited a potentially broader scope of commercial application.

Apart from the foregoing, the prior art type alloy in question has also been conspicuous by comparatively low stress-rupture properties and poor resistance to creep at elevated temperatures. Moreover, such alloys display a distinct propensity to prematurely become unstable upon long term exposure to high temperature.

Therefore, the major thrust of the instant invention was to devise an alloy of the 45–50% Cr-55-50% Ni type which would bring together in one composition (i) good hot workability, (ii) high cold ductility, (iii) improved high temperature, stress-rupture properties and (iv) enhanced stability at elevated temperatures, but without (v) detrimentally subverting the resistance to hot corrosion for which such alloys are noted and (vi) without being compelled to accept the limiting strictures imposed by the cast form.

It has now been found that the above desiderata can be achieved with special nickel-cobalt, high chromium alloys specially correlated as to percentages present and containing other constituents as is described herein.

Generally speaking and in accordance with the present invention, high chromium-nickel alloys contemplated herein contain from about 35 to about 47.5% chromium, about 42.5 to 55% nickel, about 2.5 to about 20 or 21% cobalt, the chromium, nickel and cobalt most advantageously being correlated to represent a point within the area ACDEGA of the accompanying diagram, up to about 0.5% aluminum, titanium in a small but effective amount up to 1.25 or 1.5%, and up to about 0.1% carbon, together with incidental elements and impurities normally associated with such materials. It has been further found that depending upon the particular chemistry, alloys within the foregoing ranges can be formed such that they are virtually completely of a single phase, to wit, gamma. In this connection, alloys within the area JHDEGJ are virtually, if not completely, of this single phase upon solution heating at, say, 2200° F. This, it has been determined, can be most advantageous. On the other hand, other compositions are characterized by more than one phase, e.g., gamma plus bcc chromium solid solution phase (alpha chromium), such duplex phases tending, however, to detract from resistance to creep.

In carrying the invention into practice, it is deemed quite beneficial that the cobalt percentage be maintained over the range of 5 to 20%, preferably from about 7.5 to 18%. It is considered that any advantages that might be gained from cobalt levels much beyond 20% do not warrant the additional cost involved. This constituent tends to lose its effectiveness beyond the 20% level, strength and corrosion resistance being affected.

While the complete theory explanative of the role of cobalt is perhaps not presently understood, it would appear that cobalt improves hot corrosion resistance even against fuel ash type environments. This in turn permits of less chromium to be used and this greatly assists workability. It also enhances stress-rupture properties and long term structural stability as will be shown herein, notwithstanding the high chromium levels contemplated. The cobalt should never fall below 2.5% and, as above indicated, beneficially is at least about 5%. Lower percentages detract from stability, and corrosion resistance can be impaired.

Nickel promotes formation of the gamma phase and above 42.5% virtually precludes the precipitation of the Co-Cr sigma phase at the higher cobalt levels. A nickel range of 44–46% together with a Cr + Co level of 56 to 54% is most desirable for hot corrosion resistance, the chromium being from 45 to 37%.

Chromium imparts its usual benefits in terms of corrosion resistance. Beyond 47 to 48%, workability and/or stability suffer. At the lower chromium levels of 36%, there is some loss in corrosion benefits but this can be markedly minimized by using cobalt at the higher end of its range. In this connection therefore, it is of advantage that the sum of the chromium plus 0.6% cobalt be at least 45% and preferably at least 47%.

Figure 3:
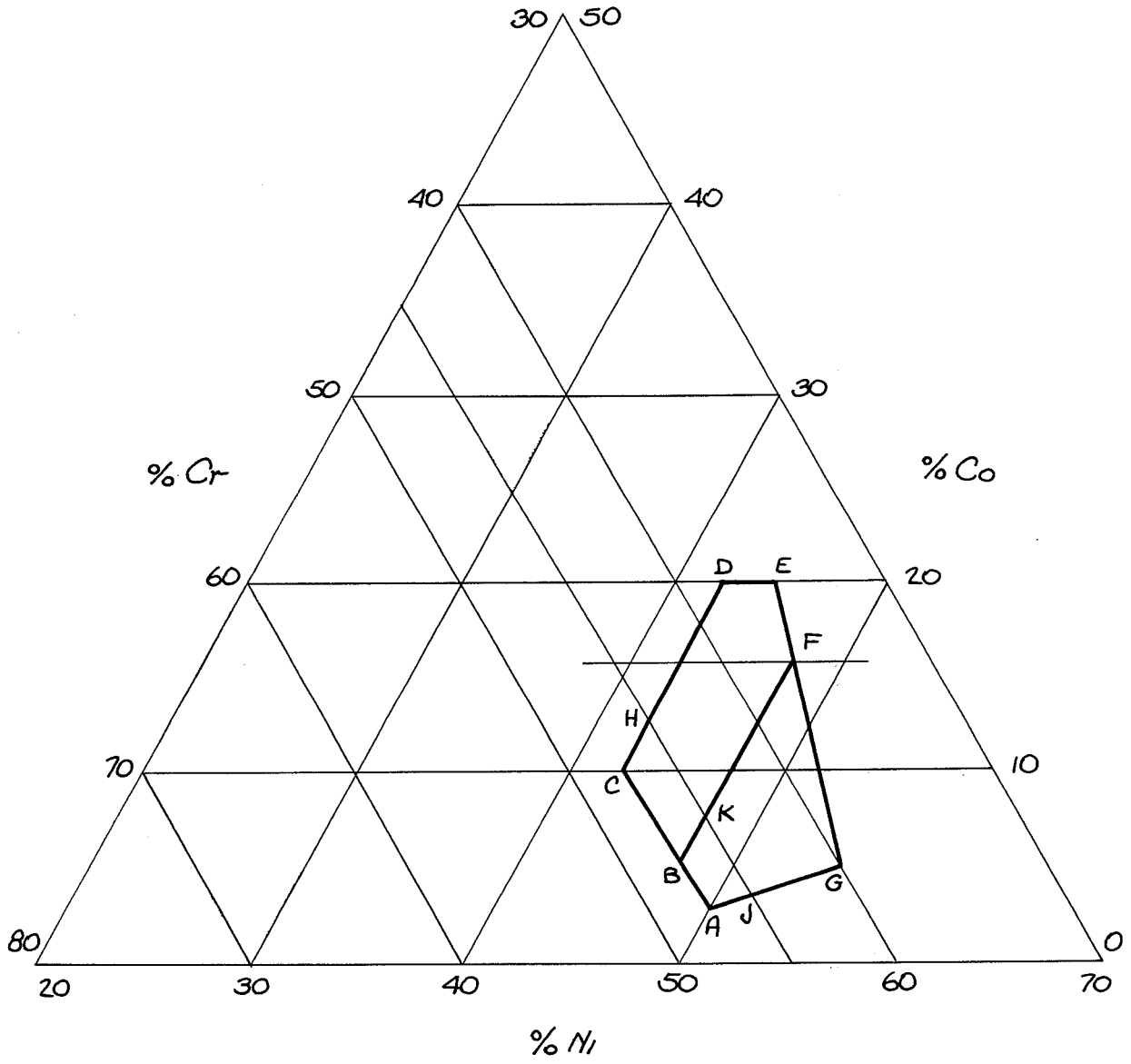

In seeking an optimum combination of properties, FIG. 3 depicts that the respective percentages of cobalt, chromium and nickel should be correlated so as to represent a point on or within the area JHDEGJ of the accompanying drawing, particularly the area KHDEFK. The latter alloys, as noted above, are not only characterized by virtually a single-phase morphology in the annealed condition, upwards of 2100°–2200° F., but additionally also offer a high level of resistance to corrosion. The single-phase structure, it is believed, markedly contributes to enhanced cold ductility and stress-rupture characteristics. Higher annealing temperatures, e.g., 2300° F., would place a good part (but probably not all) of the alpha chromium phase in solution in alloys responding to area ACHJA. The duplex phase structure is of fine grain and this can result in or contribute to a very plastic behavior at the higher temperatures (1600°–1800° F.) and poor stress-rupture life.

While carbon up to 0.25% might be tolerated in certain instances, it is most beneficial that it not exceed about 0.1%, a range of 0.01 or 0.02 to 0.08% being satisfactory. Carbon significantly above 0.1% tends to adversely affect both room temperature ductility in annealed materials and impact resistance (stability) in long-term aged material.

Titanium ties up nitrogen and improves workability, from 0.25% to 1.25% being quite satisfactory. While aluminum can be present up to about 2%, it should not exceed 0.5% or 0.75% in the interest of stability.

The following information and data are given as generally illustrative of the invention.

A series of heats, compositions being given in Table I, were melted, cast and forged to 9/16 inch square bar at 2200° F. A commercial 50% Cr-50% Ni composition, Alloy A of Table I, was also processed in similar fashion, this for affording a comparative base. In addition, a number of compositions beyond the scope of the subject invention are included, again for purposes of comparison.

TABLE I

| | COMPOSITIONS** | | | | | | | |
|---|---|---|---|---|---|---|---|---|
| Alloy | Ni % | Cr % | Co % | C % | Ti % | Al % | Si % | Fe % |
| A | 49.85 | 49.03 | n.a. | 0.05 | 0.32 | 0.07 | 0.11 | 0.15 |
| B* | 40 | 55 | 5 | — | — | — | — | — |
| C* | 35 | 55 | 10 | — | — | — | — | — |
| D* | 55 | 35 | 10 | — | — | — | — | — |
| E* | 60 | 35 | 5 | — | — | — | — | — |
| F | 43.55 | 49.61 | 5.24 | 0.05 | 1.04 | 0.18 | 0.07 | 0.18 |
| G | 39.13 | 49.68 | 10.12 | 0.07 | 0.54 | 0.15 | 0.07 | 0.15 |
| H | 33.94 | 50.22 | 14.88 | 0.06 | 0.49 | 0.09 | 0.03 | 0.18 |
| J | 32.96 | 40.40 | 25.17 | 0.03 | 1.01 | 0.12 | 0.10 | 0.16 |
| K | 38.31 | 35.14 | 25.18 | 0.04 | 0.97 | 0.12 | 0.06 | 0.14 |
| L | 37.88 | 45.29 | 15.33 | 0.07 | 1.04 | 0.14 | 0.07 | 0.15 |
| M | 32.91 | 45.13 | 20.41 | 0.11 | 1.02 | 0.15 | 0.07 | 0.16 |
| N | 47.98 | 35.35 | 15.17 | 0.07 | 1.03 | 0.17 | 0.09 | 0.11 |
| 1 | 44.00 | 45.53 | 9.74 | 0.05 | 0.89 | 0.13 | 0.07 | 0.13 |
| 2 | 42.90 | 35.19 | 20.38 | 0.12 | 1.00 | 0.18 | 0.05 | 0.13 |
| 3 | 48.18 | 45.22 | 5.18 | 0.08 | 0.99 | 0.14 | 0.07 | 0.10 |
| 4 | 42.97 | 40.25 | 15.24 | 0.11 | 1.02 | 0.16 | 0.08 | 0.13 |
| 5 | 49.70 | 39.00 | 9.73 | 0.07 | 1.01 | 0.11 | 0.02 | 0.13 |
| 6 | 53.25 | 40.19 | 5.17 | 0.07 | 0.88 | 0.13 | 0.18 | 0.10 |

*nominal
**plus impurities, Mn ≦01; Cu <0.035; S <0.008

The first property or characteristic evaluated was workability, both hot and cold workability being assessed.

WORKABILITY

In terms of hot workability, the alloys were evaluated on the basis of (i) poor workability, meaning the alloys could not be forged at all, (ii) marginal workability, meaning the alloys contained cracks of such a nature as to require delicate practice (commercially undesirable), or (iii) good workability, i.e., forged to 9/16 inch bar without problem. All heats were forged at 2200° F. for evaluation purposes.

Alloys B, C, D and E all performed poorly. It would be expected that Alloys B and C (55% Cr) could not be hot worked. But on the basis of extensive evaluation of alloys within the invention, the behavior of Alloys D and E remains to be explained. While Alloy A was workable, it was not as workable as Alloys 1 to 6. Alloys F, G and H displayed but marginal hot workability, serious cracking being observed. It might be noted at this point that while the hot workability of Alloys J through N was satisfactory, other deficiencies removed them from the scope of the invention as will be shown infra.

Cold workability was determined in terms of cold (room temperature) ductility of annealed material, a 2200° F. treatment for one (1) hour followed by air cooling being used. Reduction in area values, another measuring stick, were also assessed. These data are reported in Table II. (Alloys B through E were not further tested.)

TABLE II

| Alloy* | Ni | Cr | Co | Elongation, % | Reduction of Area, % |
|---|---|---|---|---|---|
| A | 50 | 50 | — | 29.5 | 38.7 |
| F | 45 | 50 | 5 | 12.0 | 16.5 |
| G | 40 | 50 | 10 | 5.0 | 18.1 |
| H | 35 | 50 | 15 | 5.0 | 10.8 |
| J | 35 | 40 | 25 | 68.0 | 62.5 |
| K | 40 | 35 | 25 | 87.0 | 62.8 |
| L | 40 | 45 | 15 | 32.0 | 40.0 |
| M | 35 | 45 | 20 | 32.0 | 32.3 |
| N | 50 | 35 | 15 | 66.0 | 58.3 |
| 1 | 45 | 45 | 10 | 52.0 | 57.1 |
| 2 | 45 | 35 | 20 | 57.0 | 51.0 |
| 3 | 50 | 45 | 5 | 42.0 | 49.0 |
| 4 | 45 | 40 | 15 | 53.0 | 64.5 |
| 5 | 50 | 40 | 10 | 70.0 | 60.9 |
| 6 | 55 | 40 | 5 | 58.0 | 55.1 |

Note: all alloys annealed 2200° F. plus Air Cool
* = nominal

It will be noted that Alloy A (nominally 50% Cr) exhibited an annealed elongation (cold ductility) of about 30%, a level which severely hampers production and fabrication. This level can be markedly increased in accordance with the instant invention (Alloys 1–6), ductility levels upwards of 50% and up to 70% being achieved. A comparison of Alloys 3 and 1 reflect that at the higher chromium levels, roughly 45% for these two alloys, the cobalt level should be on the higher side. This generally followed at the 40% chromium level also, Alloys 4, 5 and 6. In this connection, Alloy 5 contained 0.11% carbon and ductility was lower. As above indicated, in seeking the optimum by way of workability the carbon should be kept below about 0.08 or 0.09%. This together with chromium percentages not higher than 44–45% lends to good workability and fabricability.

STRESS-RUPTURE AT ELEVATED TEMPERATURE

A previously reflected, stress-rupture properties of wrought 50% Cr-50% Ni type alloys are deemed wanting. Apart from stress-rupture strength per se, such alloys inherently have low resistance to creep, largely due, it is thought, to their fine-grain, two-phase structure. This has occasioned use of cladding techniques or the cast form with their built-in limitations.

In any case, stress-rupture properties were determined at 1200°, 1400°, 1600° and 1800° F. at various stresses. Results were extrapolated to a 100 hour stress-rupture life base and are set forth in Table III.

TABLE III

| Alloy | Ni | Cr | Co | 1200° F. Extrapolated 100 hr. life | 1200° F. Stress ksi | 1400° F. Extrapolated 100 hr. life | 1400° F. Stress ksi | 1600° F Extrapolated 100 hr. life | 1600° F Stress ksi | 1800° F. Extrapolated 100 hr. life | 1800° F. Stress ksi |
|---|---|---|---|---|---|---|---|---|---|---|---|
| A | 50 | 50 | | 100 | 28 | 100 | 915 | 100 | 3.6 | 100 | 1.5 |
| F | 45 | 50 | 5 | 100 | 47.0 | 100 | 16.0 | 100 | 5.0 | 100 | 2.2 |
| G | 40 | 50 | 10 | " | 41.0 | " | 15.0 | " | 5.0 | " | 2.3 |
| H | 35 | 50 | 15 | " | 40.0 | " | 16.0 | " | — | " | — |
| J | 35 | 40 | 25 | " | 64.0 | " | 23.0 | " | 8.5 | " | 4.8 |
| K | 40 | 35 | 25 | " | 50.0 | " | 20.0 | " | 9.8 | " | 5.1 |
| L | 40 | 45 | 15 | " | 44.0 | " | 22.0 | " | 8.0 | " | 2.5 |
| M | 35 | 45 | 20 | " | 60.0 | " | 24.0 | " | 7.8 | " | 3.0 |
| N | 50 | 35 | 15 | " | 63.0 | " | 24.5 | " | 10.0 | " | 5.3 |
| 1 | 45 | 45 | 10 | " | 56.0 | " | 16.0 | " | — | " | 2.4 |
| 2 | 45 | 35 | 20 | " | 71.0 | " | 23.0 | " | 10.5 | " | 5.6 |
| 3 | 50 | 45 | 5 | " | 54.0 | " | 17.5 | " | 6.1 | " | 2.7 |
| 4 | 45 | 40 | 15 | " | 63.0 | " | 21.0 | " | 8.8 | " | 4.8 |
| 5 | 50 | 40 | 10 | " | 49.0 | " | 27.0 | " | 7.8 | " | 5.1 |
| 6 | 55 | 40 | 5 | " | 36.0 | " | 21.0 | " | 9.0 | " | 4.0 |

Note: all alloys annealed 2200° F. plus Air Cool

As can be seen from a perusal of Table III, the effect imparted by cobalt was quite pronounced particularly at the 1200° and 1400° F. temperatures, stress-rupture life being raised considerably. Its effect at 1600° and 1800° F. was less pronounced. Over the 1600°–1800° F. temperature range is where grain size can be of extreme significance. An annealing treatment at 2300° F. rather than 2200° F. improved the 1800° F. temperature life.

FIG. 1 offers, in terms of stress-rupture strength, a general graphic representation of a 45% nickel alloy within the invention and containing varying amounts of chromium (45%, 40% and 35) and cobalt (10%, 15% and 20%) versus a 50% Cr-50% Ni alloy. The beneficial effect of cobalt will be observed.

HOT CORROSION RESISTANCE

The 50% Cr-50% Ni alloys are noted for their ability to withstand the corrosive effects induced by combustion products of low-grade fuels containing one or more of sulfur, sodium and vanadium. Therefore, a number of alloys were subjected to a standard 80% $V_2O_5$ + 20 $Na_2SO_4$ crucible test. This was a 16 hour test conducted at 1650° F. (duplicate samples) and the results are given in Table IV.

TABLE IV

| Alloy | Ni % | Cr % | Co % | Weight Loss*, 80% $V_2O_5$ + 20 $Na_2SO_4$ |
|---|---|---|---|---|
| A | 50 | 50 | | 105 mg/cm² |
| F | 45 | 50 | 5 | n.d. |
| G | 40 | 50 | 10 | n.d. |
| H | 35 | 50 | 15 | n.d. |
| J | 35 | 40 | 25 | 183 |
| K | 40 | 35 | 25 | 244 |
| L | 40 | 45 | 15 | 107 |
| M | 35 | 45 | 20 | 120 |
| N | 50 | 35 | 15 | 222 |
| 1 | 45 | 45 | 10 | 120 |

TABLE IV-continued

| Alloy | Ni % | Cr % | Co % | Weight Loss*, 80% $V_2O_5$ + 20 $Na_2SO_4$ |
|---|---|---|---|---|
| 2 | 45 | 35 | 20 | 163 |
| 3 | 50 | 45 | 5 | 97 |
| 4 | 45 | 40 | 15 | 150 |
| 5 | 50 | 40 | 10 | 153 |
| 6 | 55 | 40 | 5 | 195 |

n.d. = not determined
* = avg. 2 tests

Apart from other metallurgical properties, it can be seen that alloys within the invention exhibit good hot corrosion resistance to a known aggressive corrosion medium, notwithstanding reduced levels of chromium. If one were to establish an arbitrary weight-loss of 20 mg/cm² maximum, even alloys containing down to 35% chromium would be acceptable.

Figure 2:
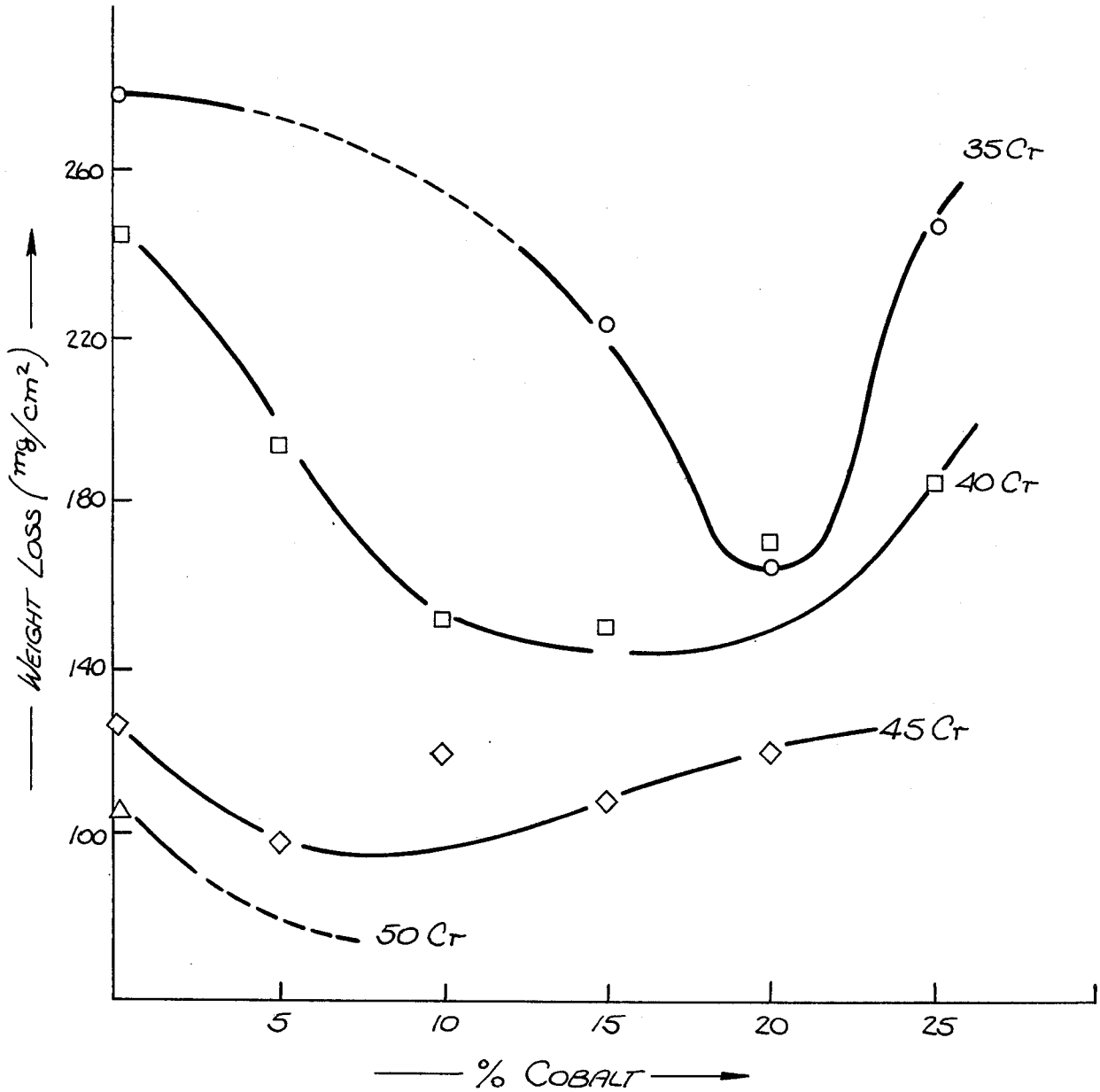

FIG. 2 graphically depicts that a nickel content of about 44–46% (Cr + Co of 54–56%) which lends to maximum corrosion resistance.

ELEVATED TEMPERATURE STABILITY

Upon exposure to elevated temperature, say 1200° F., the 50% Cr-50% Ni alloy is susceptible to premature stability failure, as determined by resistance to impact. It would seem that precipitation of bcc, chromium rich, alpha phase is largely causative of this defect. Accordingly, room temperature impact tests were conducted to evaluate alloys within the invention as well as those without the invention. Three conditions were studied: (i) annealed at 2200° F./1 hr. + air cooling (A.C.), (ii) annealed at 2200° F./1 hr. + A.C. plus exposure to 1200° F. for 100 hours; and (iii) annealed at 2200° F./1 hr. + A.C. plus 100 hour exposure to 1400° F. Charpy V-Notch impact testing was employed and the results appear in Table V.

TABLE V

| Alloy | Ni | Cr | Co | Charpy V-Notch, foot pounds 2200° F./hr. | 2200° F./hr. AC + 100 hr./1200° F. | 2200° F./hr. AC + 100 hr./1400° F. |
|---|---|---|---|---|---|---|
| A | 50 | 50 | | 25.5 | 8.0 | 15.0 |
| F | 45 | 50 | 5 | 7.0 | — | — |
| G | 40 | 50 | 10 | 7.0 | — | — |
| H | 35 | 50 | 15 | 4.5 | — | — |
| J | 35 | 40 | 25 | 240.0 | 145.0 | 68.0 |
| K | 40 | 35 | 25 | 240.0 | 163.0 | 110.0 |
| L | 40 | 45 | 15 | 30.0 | 37.0 | 45.0 |
| M | 35 | 45 | 20 | 27.0 | 18.0 | 9.0 |
| N | 50 | 35 | 15 | 240.0 | 128.0 | 96.4 |
| 1 | 45 | 45 | 10 | 85.0 | 46.5 | 18.0 |
| 2 | 45 | 35 | 20 | 124.0 | 89.0 | 62.0 |
| 3 | 50 | 45 | 5 | 54.0 | 33.0 | 20.0 |
| 4 | 45 | 40 | 15 | 134.0 | 84.0 | 55.0 |

TABLE V-continued

| Alloy | Ni | Cr | Co | Charpy V-Notch, foot pounds 2200° F./hr. | 2200° F./hr. AC + 100 hr./ 1200° F. | 2200° F./hr. AC + 100 hr./ 1400° F. |
|---|---|---|---|---|---|---|
| 5 | 50 | 40 | 10 | 128.0 | 55.0 | 40.0 |
| 6 | 55 | 40 | 5 | 141.0 | 25.0 | 35.0 |

Certainly in terms of comparison with the representative commercial 50% Cr-50% Ni Alloy A, alloys within the invention manifest a most decided improvement. In the 50% Cr-50% Ni prior art alloy alpha phase is present in the annealed condition prior to long term elevated temperature (1200° F. and 1400° F.) stability exposure. Impact strength dropped from 25.5 ft.-lbs. to 8.0 ft.-lbs. at 1200° F. This same behavior was witnessed for a 45 Cr-55% Ni nominal composition, going from 139 ft.-lbs. to 12 ft.-lbs. at 100 hour exposure at 1200° F.

For stability purposes a minimum impact strength at 1200° and 1400° F. of about 20 ft.-lbs. is deemed adequate, a criterion consistently satisfied in accordance with the invention, particularly with alloys containing less than 45% chromium and not greater than 0.1% carbon.

At the risk of redundancy, alloys containing 45% or more of chromium should be solution annealed above 2200° F, say from 2250° F. to 2325° F. e.g., about 2300° F. This will place a greater amount of alpha phase in solution (at 42–43% Cr virtually all the alpha phase will be put in solution), contributing to control of grain size (eliminate very fine grain structure) and thus improve stress-rupture characteristics as referred to previously. Carbon levels below 0.10% minimize the formation of globular carbides (considered to be of the $M_{23}C_6$ type) which detract from certain mechanical properties.

By reason of the combination of properties characteristic of the alloys within the invention, it is considered that they are capable of playing a much wider commercial role than 50% Cr-50% Ni alloys now used. It is deemed that the subject alloys will find use in applications requiring elevated temperature stress-rupture strength, particularly where the combustion products of low grade fuel will be encountered, e.g., superheater tubes and shields, soot blower tubes, boiler splash and baffle plates and tube support, and separation hardware in the areas of power generation, thermal and chemical processing and the pyrolysis of spent pulping liquors.

Although the invention has been described in connection with preferred embodiments, modifications may be resorted to without departing from the spirit and scope of the invention, as those skilled in the art will readily understand. Such are considered within the purview and scope of the invention and appended claims.

I claim:

1. A high chromium, nickel-cobalt alloy characterized by good (i) hot and cold workability notwithstanding the chromium levels, (ii) stress-rupture strength at high temperatures, (iii) hot corrosion resistance to the combustion products of low-grade fuels, and (iv) stability at elevated temperature, said alloy consisting essentially of from 35 to about 45% chromium, about 42.5 to 55% nickel, from 2.5 to about 20% cobalt, the percentages of chromium, nickel and cobalt being correlated to represent a point on the area JHDEGJ of the accompanying drawing, titanium in a small but effective amount to improve workability or tie up nitrogen and up to about 1.5%, carbon in an amount up to about 0.1%, and up to about 0.75% aluminum.

2. The alloy of claim 1 in which the chromium, nickel and cobalt are correlated to represent a point within the area KHDEFK of the accompanying drawing.

3. The alloy of claim 2 having a substantially gamma morphology.

4. The alloy of claim 2 in which the cobalt is at least 5% and the aluminum does not exceed about 0.5%.

5. The alloy of claim 2 in which chromium plus 0.6 times the cobalt is at least 45%.

6. The alloy of claim 4 in which the cobalt is from 7.5 to 18%.

7. The alloy of claim 1 in which the nickel is 44 to 46% and the chromium plus cobalt is about 56 to 54% with the chromium being from 45 to 37%.

8. An alloy consisting essentially of 35 to 47.5% chromium, about 42.5% to 55% nickel, about 2.5 to 21% cobalt, titanium present to improve workability or tie up nitrogen up to 1.5%, up to 0.25% carbon, and up to 2% aluminum, the chromium, nickel and cobalt being correlated to represent a point within the area ACDEGA of the accompanying drawing.

* * * * *